US009744409B2

(12) United States Patent
Wang et al.

(10) Patent No.: US 9,744,409 B2
(45) Date of Patent: Aug. 29, 2017

(54) BALL, PARTICULARLY FOR BASKETBALL PRACTICE, AND CORRESPONDING MANUFACTURE METHOD

(75) Inventors: Ming-Chih Wang, Taipei (TW); Thomas Baillon, Bangplee (TH)

(73) Assignee: DECATHLON, Villeneuve d'Ascq (FR)

( * ) Notice: Subject to any disclaimer, the term of this patent is extended or adjusted under 35 U.S.C. 154(b) by 36 days.

(21) Appl. No.: 14/122,319

(22) PCT Filed: Jul. 8, 2011

(86) PCT No.: PCT/FR2011/051632
§ 371 (c)(1),
(2), (4) Date: May 23, 2014

(87) PCT Pub. No.: WO2012/164174
PCT Pub. Date: Dec. 6, 2012

(65) Prior Publication Data

US 2014/0256477 A1 Sep. 11, 2014

(30) Foreign Application Priority Data

May 31, 2011 (FR) ..... 11 54758

(51) Int. Cl.
*A63B 69/00* (2006.01)
*A63B 39/00* (2006.01)
(Continued)

(52) U.S. Cl.
CPC ..... *A63B 41/10* (2013.01); *A63B 41/08* (2013.01); *A63B 45/00* (2013.01);
(Continued)

(58) Field of Classification Search
CPC ..... A63B 41/08; A63B 41/00; A63B 45/00; A63B 41/10; A63B 39/06
(Continued)

(56) References Cited

U.S. PATENT DOCUMENTS 2,623,747 A * 12/1952 Crowley ..... A63B 41/08 473/605
2,662,771 A * 12/1953 Crowley ..... A63B 39/00 473/610

(Continued)

FOREIGN PATENT DOCUMENTS

| | | | |
|---|---|---|---|
| CA | 790556 | A | 7/1968 |
| CN | 1824348 | A | 8/2006 |
| GB | 1102644 | A | 2/1968 |

*Primary Examiner* — Mitra Aryanpour
(74) *Attorney, Agent, or Firm* — Bookoff McAndrews, PLLC

(57) ABSTRACT

A ball useful for basketball practice and a method for manufacturing the same are provided. The ball includes an inflatable bladder covered with one or more flexible elongate elements wound around the surface of the bladder. The ball also includes an outer covering with at least two outer panels separated by at least one strip of elastomeric material. The outer panels and the strip(s) are placed directly onto the wound flexible elongate element(s). The manufacture-method particularly involves covering the inflatable bladder with the flexible elongate element(s) wound on the surface of the bladder, and placing the outer covering, including the outer panels separated by the strip(s) of elastomeric material, directly onto the wound flexible elongate element(s).

10 Claims, 2 Drawing Sheets

(51) Int. Cl.
*A63B 41/10* (2006.01)
*A63B 41/08* (2006.01)
*A63B 45/00* (2006.01)

(52) U.S. Cl.
CPC ..... *A63B 69/0071* (2013.01); *A63B 2208/12* (2013.01); *A63B 2225/62* (2013.01); *A63B 2243/0037* (2013.01); *Y10T 156/1089* (2015.01)

(58) Field of Classification Search
USPC ..... 473/447, 604, 594, 595, 596, 599, 603, 473/600, 605; D21/713
See application file for complete search history.

(56) References Cited

U.S. PATENT DOCUMENTS 2,688,488 A * 9/1954 Crowley ..... A63B 41/08 473/605
3,219,347 A 11/1965 Way
3,508,750 A 4/1970 Henderson
3,863,923 A * 2/1975 Anderson ..... A63B 39/06 473/604
5,310,178 A * 5/1994 Walker ..... A63B 41/08 473/605
5,636,835 A * 6/1997 Schindler ..... A63B 41/08 473/605
5,681,233 A * 10/1997 Guenther ..... A63B 41/00 473/604
6,123,633 A * 9/2000 Guenther ..... A63B 41/08 473/596
6,398,894 B1 6/2002 Lee
6,663,520 B2 * 12/2003 Ou Chen ..... A63B 41/00 473/604
6,726,582 B1 4/2004 Kuo
7,601,085 B2 * 10/2009 Maziarz ..... A63B 41/08 473/604
2002/0098928 A1 * 7/2002 Ou ..... A63B 41/08 473/604
2003/0064839 A1 * 4/2003 Guenther ..... A63B 41/08 473/604
2006/0068951 A1 3/2006 Chang
2006/0148601 A1 * 7/2006 Ou ..... A63B 41/10 473/601
2008/0188334 A1 * 8/2008 Feeney ..... A63B 41/08 473/605
2009/0011878 A1 * 1/2009 Ou ..... A63B 41/08 473/605

* cited by examiner

BALL, PARTICULARLY FOR BASKETBALL PRACTICE, AND CORRESPONDING MANUFACTURE METHOD

TECHNICAL FIELD OF THE DISCLOSURE

The invention relates to a ball and a method for manufacturing said ball. It is particularly applicable in the field of basketballs.

BACKGROUND OF THE DISCLOSURE

Balls, like those used for basketball practice, are often too heavy and/or too hard to allow beginners to derive pleasure from practicing the sport quickly.

These drawbacks are in particular related to the manufacturing method and the materials used for manufacturing.

More specifically, a ball is known, for example from document GB 1,102,644, comprising an inflatable bladder covered with a winding of flexible threads embedded in an elastomer layer that is vulcanized.

An outer coating formed by panels is positioned on top of the layer of vulcanized elastomer in which the wound flexible threads are embedded. These panels are separated by edges formed in the elastomer layer during vulcanization.

Since such a ball comprises a rubber or similar carcass, obtained by vulcanization, it is particularly rigid. When a game is played with such a ball, contact with the hands can be painful, in particular for children, due to that rigidity and hardness.

The invention therefore aims to resolve the aforementioned problems, among others.

SUMMARY OF THE DISCLOSURE

The invention thus relates to a ball, and the corresponding manufacturing method, making it possible to practice a sport such as basketball while improving users' sensations.

The ball according to the invention, which is particularly well suited to the practice of basketball, comprises an inflatable bladder at least partially covered by one or more flexible elongate elements wound around the surface of the inflatable bladder.

The ball also comprises an outer covering including at least two outer panels separated by at least one strip of elastomeric material.

The outer panels and the strip(s) are placed directly onto the wound flexible elongate element(s).

Thus, the ball according to the invention does not comprise an intermediate layer of a vulcanized elastomeric material. Consequently, the ball is less rigid and lighter, which allows users, for instance children, to suffer less pain when they catch the ball in their hands, and to throw the ball more easily and further.

In a first embodiment, the strip(s) cover no more than 50% of the surface of the ball.

In a second alternative embodiment, optionally combined with the first, the outer panels comprise a first layer of a flexible plastic material, for example polyurethane or vinyl polychloride.

In a third alternative, which may be combined with one or more of the preceding alternatives, the outer panels comprise a second fabric layer, preferably oriented toward the wound flexible elongate elements.

In a fourth alternative embodiment, optionally combined with one or more of the preceding alternatives, the wound flexible elongate element(s) comprise flexible threads.

These flexible threads may be made from a synthetic material, such as nylon.

In a fifth alternative embodiment, optionally combined with one or more of the preceding alternatives, the wound flexible elongate element(s) comprise flexible fabric strips.

These flexible fabric strips may be made from a synthetic fabric.

Furthermore, the manufacturing method in particular consists of at least partially covering an inflatable bladder with one or more flexible elongate elements wound around the surface of the inflatable bladder, and placing an outer covering comprising at least two outer panels separated by at least one strip of an elastomeric material.

The outer covering is placed by placing the outer panels and the strip(s) directly on the wound flexible elongate element(s).

In a first alternative embodiment, the strips are placed such that they cover no more than 50% of the surface of the ball.

In a second alternative embodiment, optionally combined with the preceding alternative, the outer panels are made from a first layer of a flexible plastic material, for example polyurethane or vinyl polychloride.

A second fabric layer may be glued beneath the first layer.

In a third alternative embodiment, optionally combined with one or more of the preceding alternatives, in order to place the strip(s) directly on the wound elongate element(s), said strip(s) are placed in the bottom of a mold in which the inflatable bladder, at least partially covered by the wound flexible elongate element(s), is placed.

Next, the inflatable bladder is placed under pressure, then the assembly is heated, so as to vulcanize the strip(s).

In a fourth alternative embodiment, optionally combined with one or more of the preceding alternatives, to place the outer panels directly on the wound elongate element(s), the outer panels are cut from a suitable material and said outer panels are glued adjacently to the strip(s) previously placed.

In a fifth alternative embodiment, optionally combined with one or more of the preceding alternatives, to at least partially cover the inflatable bladder with the wound flexible elongate element(s), the flexible elongate element(s) are passed through a glue bath, the inflatable bladder is placed in contact with the flexible elongate element(s), and the inflatable bladder is rotated so as to wind the flexible elongate element(s) around the inflatable bladder.

BRIEF DESCRIPTION OF THE DRAWINGS

Other features and advantages of the invention will appear more clearly and completely upon reading the description below of preferred embodiments and implementations, which are provided as non-limiting examples and in reference to the following appended drawings.

MORE DETAILED DESCRIPTION

Figure 1:
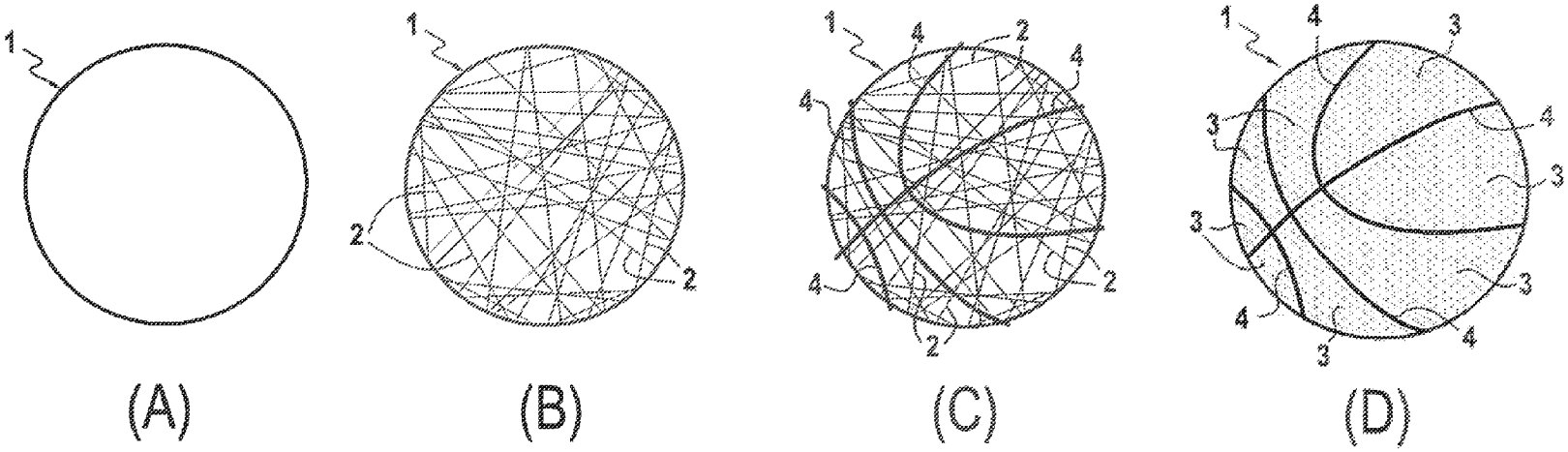
FIG. 1: diagrammatically shows the manufacturing method according to the invention.

The method shown in FIG. 1 in particular consists of using an inflatable bladder 1, which is effectively inflated, as shown in (A).

Next, a winding of one or more flexible elongate elements 2 is placed, wound around the bladder 1, so as to at least partially cover the surface of the bladder 1, as shown in (B).

In one particular embodiment, it is for example possible to place three threads 2, such as nylon threads, previously passed through a glue bath, in a machine in which the bladder 1 is also placed, and which causes said bladder 1 to rotate so as to wind the threads 2 around the bladder 1.

The elongate element(s) 2 may also be fabric strips, for example made from nylon.

Once the elongate element(s) 2 are wound around the bladder 1, it is possible to carry out the step consisting of placing the elastomeric strip(s) 4, as shown in (C).

In the alternative shown in FIG. 1, inasmuch as it involves a basketball, three strips 4 are placed. One of the strips 4 forms a circle corresponding to the equator of the ball, and a second of said strips 4 also forms a circle, but which corresponds to a meridian. Lastly, the third strip 4 forms, if laid flat, an ellipsoid whereof the large axis is formed by a portion of the first or second strip 4 also laid flat. The third strip 4 thereby intersects the first or second strip 4 in two places near one of the two intersections between the first and second strips 4.

When they are placed, these strips 4, which are made from an elastomeric material such as rubber, are placed in the bottom of two half-molds. The bladder 1 with the winding 2, as shown in (B), is placed in the half-molds, which are closed into a single mold. Next, the bladder 1 is pressurized, and a heating step is carried out to vulcanize the elastomer of the strips 4.

Figure 2:
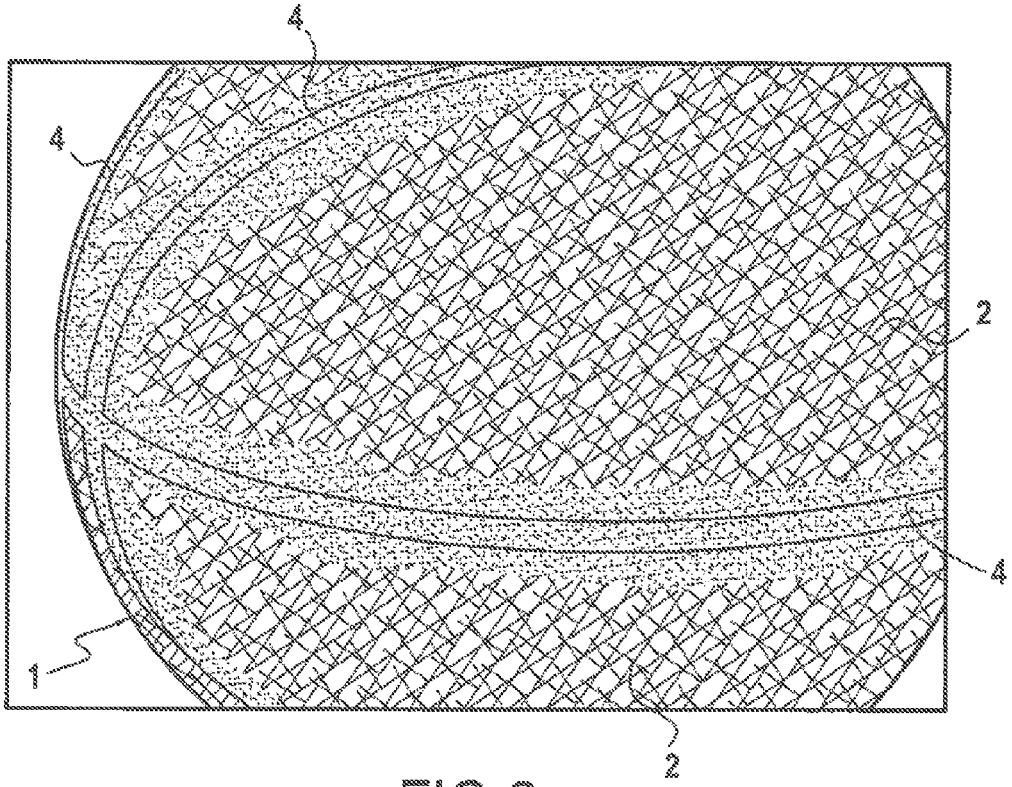
FIG. 2: diagrammatically shows the ball according to the invention, before placement of the outer panels.

FIG. 2 shows a more detailed view of the result of the step for placing the elastomeric strips 4 shown in FIG. 1 in (C), and previously described.

After the strips 4 are placed, several outer panels 3 are placed directly on the surface of the winding 2 to obtain the ball shown in (D).

The outer panels 3 separated by the strip(s) 4 that are flush with the surface are therefore part of the outer covering of the ball.

In the example shown in FIG. 1, there are therefore four outer panels 3 separated by three strips 4 of an elastomeric material.

The outer panels 3 may be made up of a layer of a flexible plastic material, such as polyurethane or vinyl polychloride.

Optionally, an additional fabric layer is placed, preferably so as to be oriented toward the winding 2, therefore toward the bladder 1.

The outer panels 3 are cut to the desired dimensions, then, when they comprise only the layer of flexible plastic material, are glued rolled on the bladder 1 surrounded by the winding 2, adjacent to the strip(s) 4.

When the outer panels 3 also comprise a layer of fabric, said fabric layer is glued on one of the faces of the outer panels 3 beforehand, with the two layers being pressed between two rollers.

Thus, the surface of the carcass of the ball or the ball itself, covered by the strips 4 of elastomeric material, is at most equal to 50% of the total surface.

In fact, in the case of a basketball, as shown in FIG. 1, illustrations (C) and (D), and in FIG. 2, this surface covered by the strips 4 of elastomeric material may even be less than or equal to 10% of the total surface.

One can therefore see that in a ball according to the invention, there is no elastomeric layer covering or embedding the winding 2 on the surface of the bladder 1, but only a series of strips 4.

The quantity of elastomer used is therefore much smaller with a ball according to the invention compared to a ball according to the state of the art. As a result, the weight of the ball is reduced. The weight reduction depends on the size of the ball and may reach 100 g.

Furthermore, the sensation of hard contact upon catching the ball is reduced, since the hardest and most rigid parts correspond to the zones where the strips 4 of vulcanized elastomeric material are placed, and are reduced.

It is specified that the entire description above is provided as an example, and is therefore not limiting with respect to the invention.

In particular, the invention is not limited to the manufacture of a basketball with exactly three strips 4 of elastomeric material and exactly four outer panels 3.

The invention claimed is:

1. A ball, in particular for practicing basketball, comprising:

an inflatable bladder at least partially wound by one or more flexible elongate element(s);

a plurality of elastomeric seams positioned directly onto the at least partially wound inflatable bladder;

an outer covering including a plurality of outer panels positioned directly onto the at least partially wound inflatable bladder;

wherein one elastomeric seam of the plurality of elastomeric seams is positioned between each two outer panels of the plurality of outer panels and wherein the plurality of elastomeric seams cover no more than 50% of the outer surface of the ball;

wherein there is no elastomeric layer covering or embedding the one or more flexible elongate element(s) on the surface of the inflatable bladder except for the plurality of elastomeric seams, thereby reducing the overall weight of the ball;

wherein each of the plurality of outer panels comprises a first layer of a flexible plastic material, the flexible plastic material being different from the material of the elastomeric seams; and wherein each of the plurality of outer panels is glued to said one or more flexible elongate element(s) adjacent to the plurality of elastomeric seams.

2. The ball according to claim 1, wherein the first layer of a flexible plastic material comprises polyurethane or vinyl polychloride.

3. The ball according to claim 1, wherein the one or more flexible elongate element(s) comprise flexible threads.

4. The ball according to claim 3, wherein the flexible threads are made from a synthetic material.

5. The ball according to claim 4, wherein the synthetic material comprises nylon.

6. A method for manufacturing a ball, such as a ball for practicing basketball, comprising the steps of:

partially winding one or more flexible elongate element(s) around an inflatable bladder;

placing a plurality of elastomeric seams directly onto the at least partially wound inflatable bladder, the plurality of elastomeric seams covering no more than 50% of the outer surface of the ball, and placing an outer covering including a plurality of outer panels directly onto the at least partially wound inflatable bladder, wherein one elastomeric seam of the plurality of elastomeric seams is positioned between each two outer panels of the plurality of outer panels, wherein there is no elastomeric layer covering or embedding the one or more flexible elongate element(s) on the surface of the inflatable bladder except for the plurality of elastomeric seams, thereby reducing the overall weight of the ball;

wherein each of the plurality of outer panels comprises a first layer of a flexible plastic material, the flexible plastic material being different from the material of the elastomeric seams, and wherein in order to place each of the plurality of outer panels directly on the one or more flexible elongate element(s), said each of the plurality of outer panels is cut from a suitable material and is glued adjacently to the elastomeric seams, said elastomeric seams being previously fixed by vulcanization.

7. The method according to claim 6, wherein in order to fix by vulcanization the elastomeric seams directly on the one or more flexible elongate element(s), said elastomeric seams are placed in the bottom of a mold in which the inflatable bladder, at least partially covered by the one or more flexible elongate element(s), is placed.

8. The method according to claim 7, wherein the inflatable bladder is placed under pressure, then the assembly is heated, so as to vulcanize the elastomeric seams.

9. The method according to claim 6, wherein in order to at least partially cover the inflatable bladder with the one or more flexible elongate element(s), the one or more flexible elongate element(s) are passed through a glue bath, the inflatable bladder is placed in contact with the one or more flexible elongate element(s), and the inflatable bladder is rotated so as to wind the one or more flexible elongate element(s) around the inflatable bladder.

10. The method according to claim 6, wherein the flexible plastic material is a polyurethane or a vinyl polychloride.

* * * * *